US006138724A

United States Patent [19]

Rivera et al.

[11] Patent Number: 6,138,724

[45] Date of Patent: Oct. 31, 2000

[54] SHIPBOARD PAINT DISPENSING SYSTEM

[75] Inventors: Rimi O. Rivera, Lexington Park; James M. McDonnell, Woodbine; Drew F. Jackson, Annapolis; Stephan J. Verosto, Jr., Columbia; Steven A. Stetz, Stevensville; David J. Barnes, Arnold; Michael R. Murnane, Arnold, all of Md.

[73] Assignee: The United States of America as represented by the Secretary of the Navy, Washington, D.C.

[21] Appl. No.: 09/409,053

[22] Filed: Sep. 30, 1999

[51] Int. Cl.[7] ..... B65B 1/04

[52] U.S. Cl. ..... 141/369; 141/302; 141/104; 222/64; 222/318

[58] Field of Search ..... 141/369, 285, 141/286, 301, 302, 305, 104; 222/64, 67, 72, 318

[56] References Cited

U.S. PATENT DOCUMENTS

| | | | |
|---|---|---|---|
| 1,778,210 | 10/1930 | Deutsch et al. . | |
| 1,932,976 | 10/1933 | Lamb et al. . | |
| 4,101,055 | 7/1978 | Poitras | 222/17 |
| 4,597,507 | 7/1986 | Rosenblum et al. . | |
| 4,967,938 | 11/1990 | Hellenberg . | |
| 5,445,192 | 8/1995 | Hansen . | |
| 5,494,191 | 2/1996 | Benson . | |
| 5,823,388 | 10/1998 | Green | 222/1 |
| 6,021,921 | 2/2000 | Lan et al. | 222/61 |

*Primary Examiner*—Steven O. Douglas
*Attorney, Agent, or Firm*—John Forrest; Jacob Shuster

[57] ABSTRACT

A storage chamber within a paint dispensing reservoir tank is maintained filled with paint from a refill paint source during recirculation of such paint through a paint cleansing filter within the chamber for supply of filter cleansed paint to a paint dispensing outlet under control of a metering system involving use of a valve controlled air-powered pump and flow metering regulating cylinders.

6 Claims, 2 Drawing Sheets

SHIPBOARD PAINT DISPENSING SYSTEM

The present invention relates generally to the dispensing of high viscosity fluidic material such as an epoxy paint under metered flow control.

BACKGROUND OF THE INVENTION

Dispensing systems for delivery of fluidic materials, including paint, under metered flow control is generally known in the art. Such dispensing systems include the storage of the fluidic material in a reservoir tank, to which such material is supplied through an inlet valve and withdrawn through an outlet isolation valve. However, such prior art dispensing systems do not accommodate all of the desired installational requirements associated with the storage and metered delivery of a highly viscous paint in a shipboard environment. The provision of a paint dispensing system meeting all of the shipboard type of installational requirements is therefore an important object of the present invention.

SUMMARY OF THE INVENTION

In accordance with the present invention, a paint dispensing system is designed to meet all desired criteria for shipboard installation including: configuration, material selection and operation. The configuration criteria involves maximizing paint storage volume within a compact space by use of a cross-sectionally rectangular shaped reservoir tank having a tapered bottom portion, a removable sealing lid on top of the tank and a floor support frame below the tank within which various flow controlling valves are disposed for recirculating paint filtered through the tank, refilling the tank and supplying of such filtered paint to a control system for dispensing the metered paint. The material selection criteria involves the avoidance of corrosion due to moisture or chemical attack by use of stainless steel tubing, a self-priming chemical resistant pneumatic diaphragm type pump to induce flow of the paint and lid sealing of the paint-storing tank at its upper end. The operational criteria involves use of an isolation outlet valve for the tank, a paint recirculation valve for the tank and a paint dispensing valve from which metered delivery of the paint is conducted, such paint being continuously filtered during recirculation through the tank. Precision metering of the filtered paint is controlled through a 4-way valve which controls precision dispensing of metered paint from a regulating cylinder. The dispensed paint is then caught in a pail seated on a paint can stand mounted on the front of the paint dispensing unit. The hassle usually associated with pouring, filling and refilling paint into a dispenser tank is avoided, by automatic valve controlled transfer of filtered paint into the tank reservoir.

BRIEF DESCRIPTION OF DRAWING

A more complete appreciation of the invention and many of its attendant advantages will be readily appreciated as the same becomes better understood by reference to the following detailed description when considered in connection with the accompanying drawing wherein.

DETAILED DESCRIPTION OF PREFERRED EMBODIMENT

Figure 1:
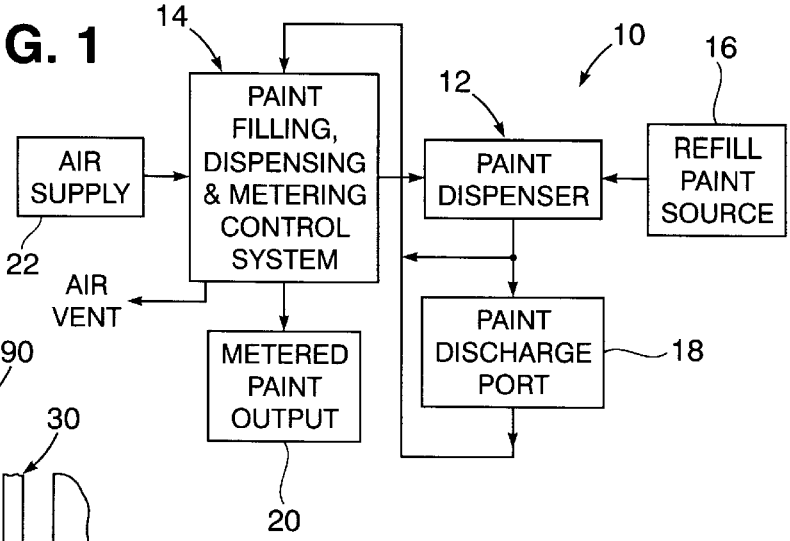
FIG. 1 is a block diagram of the paint dispensing system associated with the present invention.

Referring now to the drawing in detail, FIG. 1 diagrams a paint dispensing system, generally referred to by reference numeral 10, for shipboard use in accordance with one embodiment of the present invention. The system 10 includes as major components thereof a paint dispenser 12 and a control system 14 for paint filling, dispensing and precision metering. The paint dispenser 12 receives paint from a refill paint source 16 associated therewith. Such paint is then discharged from the dispenser 12 through a port 18, or through the control system 14 from which a precision metered output 20 of the paint is delivered under control of pressure and suction provided by inflow and venting of air from a supply 22.

Figure 2:
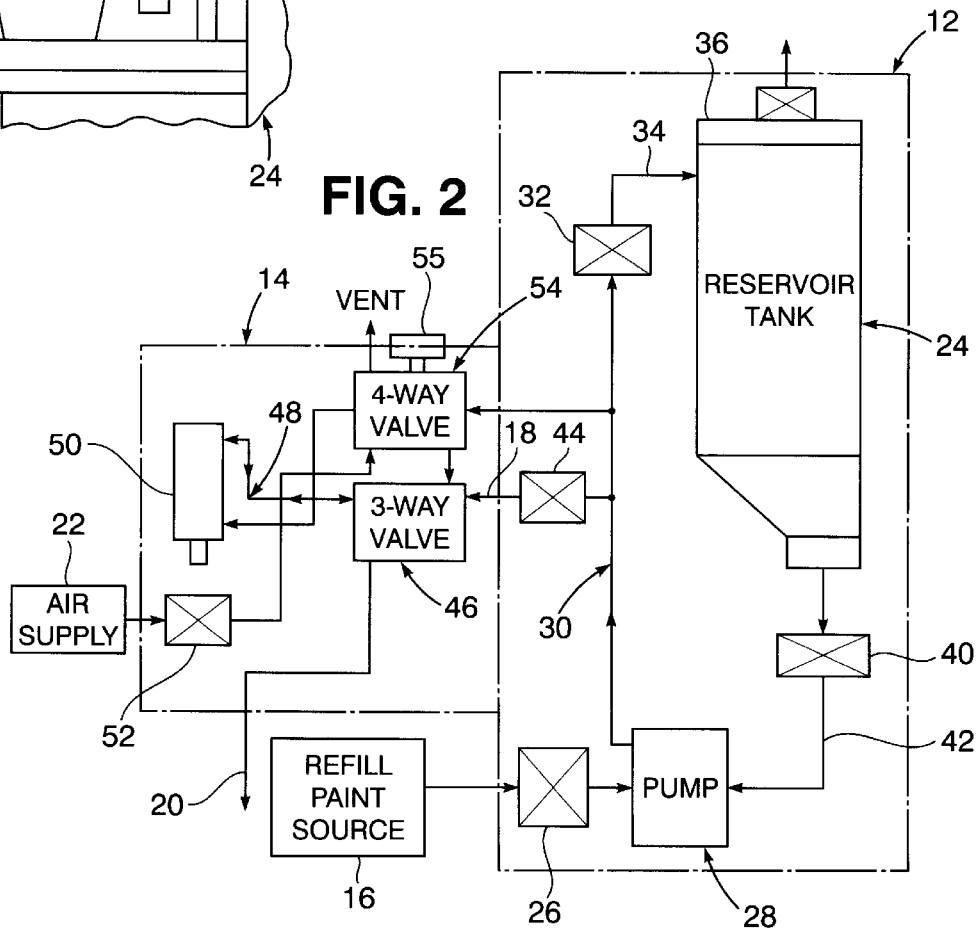
FIG. 2 is a functional block diagram illustrating the paint flow control arrangement associated with the system diagrammed in FIG. 1.

FIG. 2 diagrams the functional relationship of various apparatus components respectively associated with the paint dispenser 12 and the control system 14. The paint dispenser 12 includes a reservoir tank 24 within which the paint is stored. A storage volume of the paint derived from the refill paint source 16 through a refill control valve 26 is maintained within the tank 24 by an air powered pneumatic diaphragm pump 28 connected to valve 26, from which the paint under pressure is supplied through stainless steel tubing 30 to a paint recirculating valve 32, from which the paint is introduced into the upper end portion of the reservoir tank 24 just below its closure sealing lid 36, having a vacuum relief vent valve 38 mounted thereon.

The paint stored in the reservoir tank 24 is withdrawn for recirculation and dispensing purposes from its lower end through an isolation valve 40 when opened so as to conduct outflow of the paint under suction pressure to the pump 28 while it is supplying pressurized paint into the aforementioned tubing 30 as diagrammed in FIG. 2. Discharge of the such pressurized paint in the tubing 30 is delivered via an open and shut valve 44 from the discharge port 18, or delivery of precision metered paint is supplied from the tubing 30 into the three-way valve 46.

As also diagrammed in FIG. 2, the pressurized paint discharged from the paint dispenser 12 through port 18 is fed to the 3-way valve 46 in the control system 14 from which the metered output 20 is obtained. Operational control of system 14 through valve 46 involves inflow and outflow of paint through tubing 48 to the upper end of at least one regulating cylinder 50 associated with the control system, having a lower end to which pressurized air under control of a 4-way valve 54 is supplied at 80 psi for example. Regulation of the pressurized air by the valve 54 is controlled through its valve handle 55.

Figure 3A:
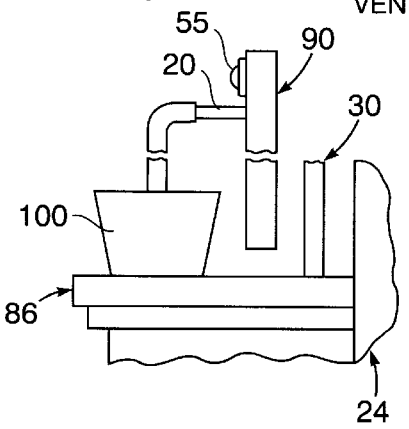
FIG. 3A is a side elevation view corresponding to a portion of FIG. 3 illustrating placement of a paint pail on the stand.
Figure 3:
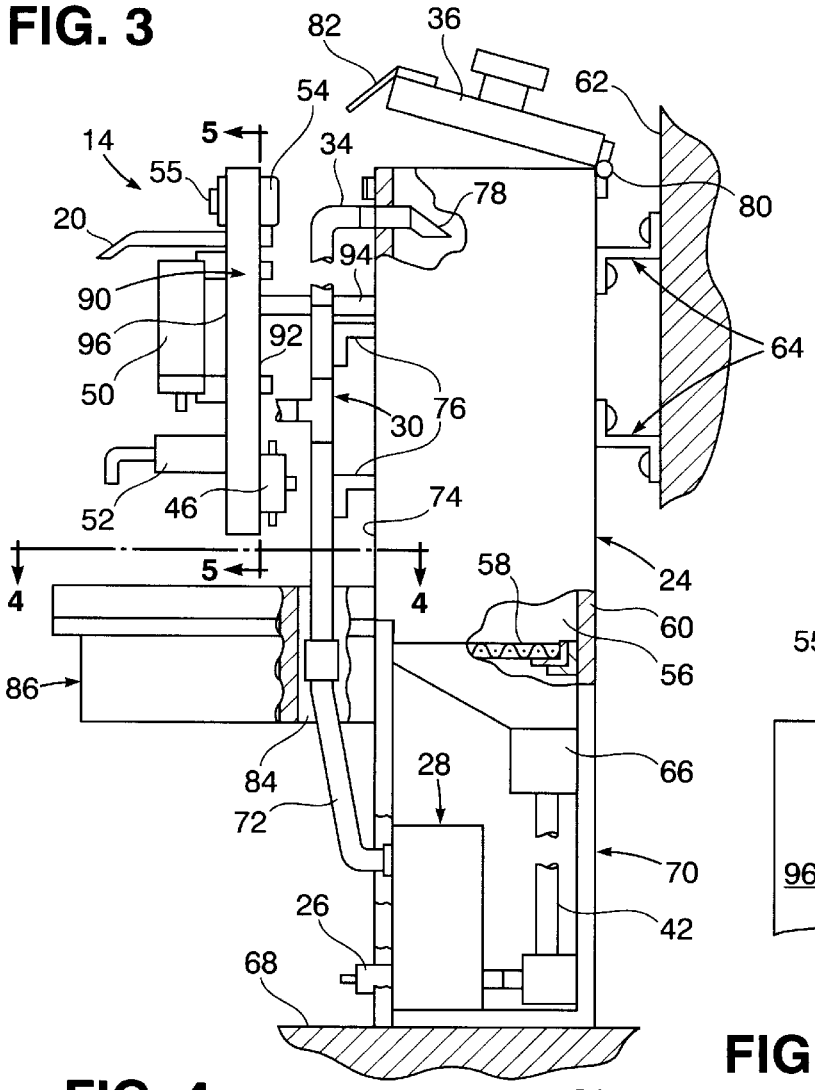
FIG. 3 is a side elevation view, with portions thereof shown in section, of the apparatus arrangement corresponding to the system diagrammed in FIGS. 1 and 2.
Figure 4:
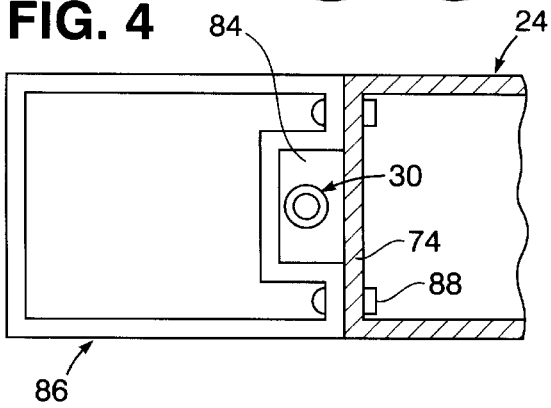
Figure 5:
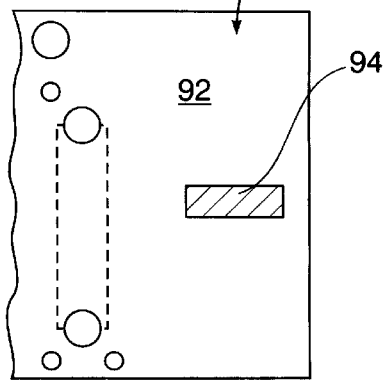

FIG. 3 illustrates an arrangement for mounting some of the components of the paint dispensing system establishing physical relationships associated therewith in accordance with the present invention. The reservoir tank 24 for example is formed by vertical walls enclosing a cross-sectionally rectangular paint storage chamber 56 above a paint cleansing filter 58. The back wall 60 of the chamber 56 is shown mounted on a vertical support surface 62 by a pair of mounting brackets 64. A tapered portion of the tank 24 extends downwardly below the filter 58 so as to cross-sectionally converge toward a lower outlet portion 66 from which the stored paint cleansed by filter 58 is withdrawn through tubing 42 for supply to the air powered diaphragm pump 28 supported on a horizontal floor surface 68 within a vertically extending framing assembly 70 connected to the lower end portions of the tank 24 above the floor surface 68. The pump 28 is supported in such framing assembly 70, having its lower self-filling port connected to the aforementioned refill control valve 26, its upper outlet port connected by a flex line 72 to the aforementioned tubing 30 mounted in forwardly spaced relation to the front wall 74 by a pair of tubing supports 76. The upper elbow portion 34 of the tubing 30 is connected to a paint injecting nozzle 78 projecting from the front wall 74 internally into the upper end portion of the tank chamber 56 just below the closure lid 36 which mounts the vacuum relief valve 38. The lid 36 is mounted by a pivot 80 on the back wall 60 of the tank 24 for pivotal displacement between the open position shown in FIG. 3 and a closed position in which it is held sealed to the tank by latches 82. The lower end of the tubing 30 connected to the flex line 72 extends through a recess 84 formed in a paint can stand 86 removably mounted by fasteners 88 on the front wall 74 of the tank 24, as shown in FIGS. 3 and 4.

Figure 6:
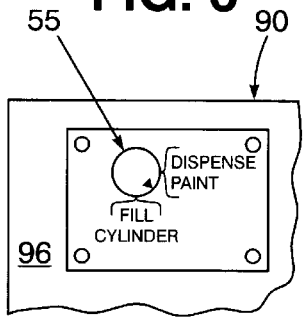
FIGS. 4, 5 and 6 are partial section views respectively taken substantially through planes indicated by section lines 4—4 and 5—5 in FIG. 3.

With continued reference to FIG. 3, the components of the control system 14 as hereinbefore described, are mounted in forwardly spaced relation to the front wall 74 of the reservoir tank 24, above the paint can stand 86, by a metering board 90. The rear side 92 of the board 90, facing the front wall 74 of the tank 24, is attached directly to the tubing 30. Also supported on the back side 92 of the board 90 are the pneumatic controlled 3-way valve 46 and 4-way valve 54 hereinbefore described with respect to FIG. 2, while the valve 52, the regulating cylinder 50 and paint discharge line 20 are supported on the front side 96 of the board 90. A valve control indicator plaque 98 is also mounted on the front side 96 of the board 90 as shown in FIG. 6, denoting "dispense paint" and "fill cylinder" valve positions thereon between which the 4-way valve control handle 55 is angularly displaced.

Based on the foregoing description, operation of the control system 14 is initiated by displacing the control handle 55 of the 4-way valve 54 to the "fill cylinder" position. Paint is then fed from the dispenser 12 through tubing 30 to the 3-way valve from which the paint flows in through tubing 48 into the cylinder 50 at its upper end. During the latter operational stage, the lower end of the cylinder 50 is vented through the 4-way valve to allow filling thereof. Once the cylinder 50 is filled with paint, the 4-way valve handle 55 is turned to the "dispense paint" position for directional reversal of the 3-way valve 46 by means of pressurized air from supply 22 fed through valve 52 to the 4-way valve 54, thereby forcing the paint out of the cylinder 50 for metered outflow through the 3-way valve 46 to the paint output line 20.

As shown in FIG. 3*a,* a flexible transfer hose 98 may be attached to the paint output line 20 for supply of the paint to a paint pail 100 placed on the stand 86. Such metered delivery of filtered paint to a paint pail on the stand 86 is accomplished by control of the 3-way valve 46 and 4-way valve 54 through the handle 55 of valve 54 under conditions imposed on the dispenser 12 and control system 14 through the valves 26, 32, 40, 44 and 52 associated therewith as hereinbefore described. According to other embodiments of the invention, plural regulating cylinders 50 with associated valving and plumbing may be associated with the control system 14 to dispense larger metered quantities of paint.

Obviously, other modifications and variations of the present invention may be possible in light of the foregoing teachings. It is therefore to be understood that within the scope of the appended claims the invention may be practiced otherwise than as specifically described.

What is claimed is:

1. A system for dispensing a viscous fluidic material, comprising: a reservoir tank enclosing a storage chamber; closure means mounted on said tank for selectively sealing the chamber therein; self-priming pneumatic pump means for recirculation of the fluidic material through said chamber when sealed by the closure means; filter means within the tank for continuous cleansing and mixing of the fluidic material during said recirculation thereof; a refill source of said fluidic material; flow control means operatively connected to the pump means for supply of the fluidic material from the refill source to the tank to maintain a predetermined quantity of the fluidic material stored within the chamber during delivery of the fluidic material from the pump means; and selectively controlled metering means operatively connected to the flow control means for dispensing a precision metered quantity of the fluidic material undergoing said delivery thereof from the pump means.

2. The system as defined in claim 1 wherein said metering means includes: a regulating cylinder having opposite ends respectively receiving pressurized air and the fluidic material being delivered by the flow control means; and selectively controlled dispensing valve means operatively connected to one of the opposite ends of the regulating cylinder for operation of the pump means in response to supply thereto of the pressurized air to dispense said metered quantity of the fluidic material from said one of the opposite ends of the regulating cylinder.

3. The system as defined in claim 2, including: a stand fixed to the reservoir tank on which a pail is adapted to be supported for receiving the fluidic material being dispensed by the dispensing valve means.

4. The system as defined in claim 3, wherein said viscous fluidic material is paint.

5. The system as defined in claim 1, wherein said viscous fluidic material is paint.

6. The system as defined in claim 1, including: a stand fixed to the reservoir tank on which a pail is adapted to be supported for receiving the metered quantity of the fluidic material being dispensed by the metering means.

* * * * *